US007503354B2

(12) United States Patent
Amano

(10) Patent No.: US 7,503,354 B2
(45) Date of Patent: Mar. 17, 2009

(54) POWDER FILLING METHOD, POWDER FILLING DEVICE, AND POWDER FILLING NOZZLE

(75) Inventor: Hirosato Amano, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 360 days.

(21) Appl. No.: 10/542,089

(22) PCT Filed: Jan. 9, 2004

(86) PCT No.: PCT/JP2004/000094

§ 371 (c)(1),
(2), (4) Date: Apr. 4, 2006

(87) PCT Pub. No.: WO2004/063010

PCT Pub. Date: Jul. 29, 2004

(65) Prior Publication Data

US 2006/0213573 A1 Sep. 28, 2006

(30) Foreign Application Priority Data

Jan. 14, 2003 (JP) ..... 2003-005350
Apr. 8, 2003 (JP) ..... 2003-104315

(51) Int. Cl.
*B65B 31/00* (2006.01)
*B65B 1/04* (2006.01)

(52) U.S. Cl. ..... 141/59; 141/98

(58) Field of Classification Search ..... 141/11, 141/67, 70, 65, 198, 286; 399/258; 406/93, 406/168

See application file for complete search history.

(56) References Cited

U.S. PATENT DOCUMENTS 3,358,059 A * 12/1967 Snyder ..... 264/51
4,730,647 A * 3/1988 Mulder ..... 141/67
4,976,296 A * 12/1990 Pope ..... 141/46
5,423,356 A * 6/1995 Reckersdrees ..... 141/67
5,711,353 A * 1/1998 Ichikawa et al. ..... 141/67

(Continued)

FOREIGN PATENT DOCUMENTS

EP 1055601 A2 * 11/2000

(Continued)

OTHER PUBLICATIONS

U.S. Appl. No. 11/911,598, filed Oct. 15, 2007, Sano, et al.

*Primary Examiner*—Gregory L. Huson
*Assistant Examiner*—Jason K Niesz
(74) *Attorney, Agent, or Firm*—Oblon, Spivak, McClelland, Maier & Neustadt, P.C.

(57) ABSTRACT

A powder filling nozzle is used for filling up a container with a powder mixed with a gas and in a fluidized state. The power filling nozzle comprises a tubular body having an opening for discharging the powder in the fluidized state into the container, and a gas separating unit disposed near the opening of the tubular body and allowing the gas delivered together with the powder in the tubular body to pass through the gas separating unit but not allowing the powder to pass through the gas separating unit. The gas separating unit serves to set the opening in a plugged state by the powder separated from the gas, so that the delivery of the powder from the tubular body into the container is stopped.

31 Claims, 6 Drawing Sheets

U.S. PATENT DOCUMENTS

| | | | | |
|---|---|---|---|---|
| 6,112,780 | A * | 9/2000 | Meheen | 141/40 |
| 6,497,259 | B1 * | 12/2002 | Wegman | 141/267 |
| 6,648,029 | B1 * | 11/2003 | Amano | 141/59 |
| 6,652,083 | B2 * | 11/2003 | Ison et al. | 347/93 |
| 6,679,301 | B2 * | 1/2004 | Makino et al. | 141/67 |
| 6,684,917 | B2 * | 2/2004 | Zhu et al. | 141/18 |
| 6,859,634 | B2 * | 2/2005 | Itoh et al. | 399/258 |
| 7,004,210 | B1 * | 2/2006 | Wegman et al. | 141/256 |
| 7,353,847 | B2 * | 4/2008 | Early | 141/9 |
| 2002/0074282 | A1 * | 6/2002 | Hermann et al. | 210/490 |
| 2004/0011425 | A1 * | 1/2004 | Wegman et al. | 141/311 A |
| 2004/0091685 | A1 * | 5/2004 | John et al. | 428/196 |
| 2006/0213573 | A1 | 9/2006 | Amano | |
| 2006/0263116 | A1 * | 11/2006 | Katsuyama | 399/258 |

FOREIGN PATENT DOCUMENTS

| | | |
|---|---|---|
| JP | 4-87901 | 3/1992 |
| JP | 6-263101 | 9/1994 |
| JP | 9-193902 | 7/1997 |
| JP | 2000-247445 | 9/2000 |
| JP | 2001-31002 | 2/2001 |
| JP | 2002-274502 | 9/2002 |
| JP | 2002-293301 | 10/2002 |

* cited by examiner

FIG.6

| TONER | TARGET AMOUNT | EMBODIMENT 1 | EMBODIMENT 2 | C. E. 1 |
|---|---|---|---|---|
| CYAN | 275g | $3\sigma=1.2$g | $3\sigma=1.3$g | $3\sigma=11.5$g |
| MAGENTA | 275g | $3\sigma=1.1$g | $3\sigma=1.2$g | $3\sigma=12.0$g |
| YELLOW | 275g | $3\sigma=1.5$g | $3\sigma=1.4$g | $3\sigma=14.2$g |
| BLACK | 550g | $3\sigma=2.3$g | $3\sigma=2.2$g | $3\sigma=24.0$g |

FIG.7

| TONER | TARGET AMOUNT | CASE 1 | CASE 2 |
|---|---|---|---|
| CYAN | 275g | 0.43 | 0.38 |
| MAGENTA | 275g | 0.44 | 0.39 |
| YELLOW | 275g | 0.41 | 0.36 |
| BLACK | 550g | 0.44 | 0.39 |

POWDER FILLING METHOD, POWDER FILLING DEVICE, AND POWDER FILLING NOZZLE

TECHNICAL FIELD

The present invention generally relates to the technology for filling up a container with minute powder represented by the toner for image formation by an electrophotographic printing system. In particular, the present invention relates to a powder filling method, a powder filling device, and a powder filling nozzle for efficiently filling powder into a small-inlet container or a small-capacity container the filling of which is difficult or impossible by a conventional system.

BACKGROUND ART

There are various types of powder filling methods for filling up a container with the powder, such as a toner for electrophotographic printing, which include a rotary valve type, a screw feeder type and an auger type. The fundamental concept of these methods is to drop the powder by its gravity from the powder filling device to the container disposed under the powder filling device, so that the container is filled up with the powder.

Especially, the auger-type powder filling method is well known and put in practical use. This method is considered as an efficient method for filling up a container of a fixed capacity with the powder. See Japanese Laid-Open Patent Applications No. 04-087901 and No. 06-263101.

Immediately after the container is filled up with the powder by these powder filling methods, a certain amount of air is contained in the powder. In order that a large amount of powder is stored in a high-density state in the container for a short time, a powder filling method has been proposed. In this method, the suction pipe is inserted in the container and one end of the suction pipe is embedded in the powder in the container so that the air contained in the powder is reduced. See Japanese Laid-Open Patent Application No. 09-193902.

Usually, according to the auger-type powder filling method, the screw-like auger is provided inside the conical hopper near the outlet of the hopper, and the auger is rotated so that the toner within the hopper is discharged downward from the outlet. This procedure is carried out by filling the toner into one of the plurality of containers arranged and conveyed on the transport belt one by one.

In recent years, with respect to the image formation using the electrophotographic printing, there is the increasing demand for high-speed, high-clearness, high-quality image formation. With this trend, consideration is taken to the toner from the several standpoints: the average particle size of the toner is made to 10 micrometers or less, the fluidity is increased by applying metal oxide particles (the external additive) to the surface of the toner, and the low-temperature fixability of the toner is ensured by using a binding-agent resin of a low melting point.

However, the toner is pressurized by rotation of the auger in the case of the above-mentioned method, and the external additive of the toner will be separated or isolated from the surface. Furthermore, in the case of the auger type method, the external additive is buried in the toner, and the original function of increasing the fluidity by the external additive is eliminated or lost.

Moreover, in the case of the low-temperature fixing toner using a binding agent resin of a low melting point, the sticking of toner particles or aggregation is likely to occur since the toner is pressurized by rotation of the auger. Sometime the toner solidifies so that the aggregation does not return to the original state. As a result, the outlet of the hopper is clogged with the toner particles and the discharging is stopped. The problem that the toner filling work is interfered arises.

When the copying is performed with the developer in which the toner and the aggregation coexist, the quality of the reproduced image becomes inadequate since the aggregation has not a desired value of the electrostatic property.

The smaller the toner particle diameter is, the more the toner falls from the hopper to the container. The Brownian movement of such toner particles occurs in a gas regardless of the quality of the material. And it becomes easy to make an atomizing state. Then, the necessity of discharging a large amount of gas existing in the powder particles will arise, and it is difficult to form the high-density filling state of the toner in the container. It is desirable that the above-mentioned problem is solved to overcome such difficulty conjointly.

As described above, the auger type method requires a large-scale machine including the toner filling device having at least the hopper and the transport belt carrying and conveying the plurality of containers. And it is necessary that the container is arranged just below the toner filling device and filled up with the toner. Thus, the auger type method has the problem in that the arrangement of the toner filling device is fixed and several restrictions exist.

Another powder filling method has been proposed. In this method, gas is introduced to the powder filling device which stores the powder similar to the hopper, and the fluidity of the powder is increased. While the agitator is rotated, the powder from the outlet of the powder filling device is delivered to the container through the conveyance piping, and the gas existing in the powder particles is discharged through the de-aeration piping before the powder reaches the container. The objective of the proposed method is to supply the powder efficiently and filling up the container with the powder in a high-density state. See Japanese Laid-Open Patent Application No. 2001-031002.

However, the proposed method requires a large-scale powder filling device in which the de-aeration piping is accurately disposed co-axially with the powder filling piping. The manufacture of such powder filling device is difficult, and the weight becomes large.

Moreover, the powder filling device and the contained are disposed at separate locations. When a small-diameter container or a container in which the internal wall of the container is configured in the shape of a spiral convex or others is used in order to facilitate the toner discharging, the delivery of the powder is prevented and mixing the powder in the container with the air is difficult.

Moreover, since the de-aeration of the powder is performed in the course of delivery of the powder to the container, the delivery of the powder is difficult. Moreover, since the agitator is used to discharge the powder from the powder filling device, the separation of the external additive from the powder and the generation of aggregation will arise similar to the auger type method, and it is difficult to attain desired filling of the powder in the container.

Another powder filling method has been proposed. In this method, an auger-type powder filling device for filling a powder such as a medical supply or food into a container, such as a plastic bag. And the filter layer is provided in the cylindrical wall surrounding the auger connected with the lower part of the hopper, and the de-aeration of the gas existing in the powder is performed through the filter layer. By the de-aeration the negative pressure is generated, and the powder falling to the plastic bag by rotation of the auger is stopped. See Japanese Laid-Open Patent Application No. 2000-247445.

However, the proposed method uses the auger type method, and the above-mentioned problems still remain unresolved. In the case of the toner powder in which the external additive adheres, the separation of the external additive from the powder easily arises when the powder passes through the inside of the rotating auger. When the external additive whose particle diameter is smaller than that of the powder is attracted through the filter layer, clogging of the filter layer may occur, and it is difficult to attain appropriate stopping function of the filter layer.

In an office where an image forming device, such as a copier or a printer, is installed, when the developing unit of the device or the toner container is directly replenished with the toner, the particulate of the toner is produced. Even if it is replenished, the toner contains a certain amount of air and it is set in a low density state.

When the toner is supplied to the developing unit having a complicated structure directly, the filling state does not become uniform and the void is created so that the quality of the reproduced image becomes poor.

The inventors have proposed a powder fluidization unit for solving the above-mentioned problems in the toner filling method as disclosed in Japanese Patent Application No. 2001-102264.

The proposed powder fluidization unit is different from the auger type method mentioned above. In this powder fluidization unit, a minimum quantity of gas is introduced uniformly into the powder within the powder fluidization unit, and a fluidized state of the powder is acquired. After that, the powder in the fluidized state is supplied by pressurization into the container separated from the powder fluidization unit so that the container is filled up with the powder.

According to the above-mentioned powder filling method proposed by the inventors, it is possible to eliminate the separation of the external additive from the toner powder or the generation of the aggregation caused by rotation of the auger as in the auger type method. Moreover, the powder filling device is made small, carrying it is easy, the operation is easy, and it is very effective in eliminating the above-mentioned problems. Therefore it is possible to perform the filling of a small-inlet container or a complicated-shaped container with the powder sufficiently.

According to the above-mentioned powder filling method, the powder in the fluidized state, produced within the powder fluidization unit, can flow into the container through the transport pipe at high speed since it is fluidized and pressurized. The container can be immediately filled with the powder and the gas.

An important technical matter for filling each of the plurality of containers with the powder of the given quantity continuously one by one is to provide a controllable method so that the incoming flow is stopped instantly after one container is filled up with the powder of a given quantity, and the incoming flow can resumed for the following container so that the following container can also be filled up with the powder of the given quantity.

If that control cannot be performed enough, the powder is atomized around the powder filling device and the powder stain may occur. Although the inventors adjusted the pressure open valve provided in the above-mentioned conventional powder fluidization unit and controlled the delivery pressure, it is found that the feature of stopping the powder flow into the container instantly is inadequate.

It is conceivable that the cause of the above problem is that, because a certain time for escaping the air from the pressure open valve is needed, the falling of the residual pressure takes some time and the distance from the powder fluidization unit to the container is too long.

Moreover, the inventors provided the mechanical stop units, such as the valve or the shutter, at the edge of the powder filling nozzle being inserted into the container as the pressure control unit. As the filling operation is performed repeatedly, the aggregation of the powder is formed. It has been confirmed that the stop control of the powder filling is not performed adequately. It is conceivable that the cause of the above problem is that the powder is pressurized by the mechanical stop unit.

DISCLOSURE OF THE INVENTION

A general object of the present invention is to provide an improved powder filling method in which the above-mentioned problems are eliminated.

A more specific object of the present invention is to provide a powder filling device and method which makes it possible to realize control which stops the delivery of the powder to the container instantly, without deteriorating the powder, and to fill up the container with the powder of the given quantity in a high-density state.

Especially the present invention aims at offering a powder filling nozzle which can solve the above-mentioned problems in the case of filling the container with the toner used for the development of an electrostatic latent image.

In order to achieve the above-mentioned objects, the present invention provides a powder filling nozzle used for filling up a container with a powder mixed with a gas and in a fluidized state, the powder filling nozzle comprising: a tubular body having an opening for discharging the powder in the fluidized state into the container; and a gas separating unit disposed near the opening of the tubular body and allowing the gas delivered together with the powder in the tubular body to pass through the gas separating unit but not allowing the powder to pass through the gas separating unit, wherein the gas separating unit serves to set the opening in a plugged state by the powder separated from the gas, so that the delivery of the powder from the tubular body into the container is stopped.

In order to achieve the above-mentioned objects, the present invention provides a powder filling device including a hermitically sealed powder fluidization unit and a powder filling nozzle, the powder filling device filling a powder, mixed with a gas and changed to a fluidized state by the powder fluidization unit, into a container through a delivery path by using the powder filling nozzle, the powder filling nozzle comprising: a tubular body having an opening for discharging the powder in the fluidized state into the container; and a gas separating unit disposed near the opening of the tubular body and allowing the gas delivered together with the powder in the tubular body to pass through the gas separating unit but not allowing the powder to pass through the gas separating unit, wherein the gas separating unit serves to set the opening in a plugged state by the powder separated from the gas, so that the delivery of the powder from the tubular body into the container is stopped.

In order to achieve the above-mentioned objects, the present invention provides a powder filling method for filling up a container with a powder in a fluidized state by using a powder filling device which includes a hermitically sealed powder fluidization unit and a powder filling nozzle, the powder filling nozzle comprising a tubular body having an opening for discharging the powder in the fluidized state into the container, and a gas separating unit disposed near the opening of the tubular body and allowing a gas delivered together with the powder in the tubular body to pass through the gas separating unit but not allowing the powder to pass through the gas separating unit, the powder filling method comprising the steps of: mixing the powder contained in the powder fluidization unit with the gas to obtain the powder in the fluidized state; delivering the powder in the fluidized state from the fluid fluidization unit into the powder filling nozzle via a delivery path so that the powder is discharged into the container from the powder filling nozzle; and setting the opening of the tubular body in a plugged state by the powder separated from the gas by the gas separating unit so that the delivery of the powder from the tubular body to the container is stopped.

According to the present invention, the powder filling nozzle, powder filling device, and powder filling method which make it possible to fill up the container with the powder of a given amount in a high-density state efficiently and precisely.

Other objects, features and advantages of the present invention will be apparent from the following detailed description when reading in conjunction with the accompanying drawings.

BRIEF DESCRIPTION OF THE DRAWINGS

FIG. 6 is a diagram for explaining the powder delivery stop function of the powder filling nozzle of the present invention.

FIG. 7 is a diagram for explaining the high-density powder filling function of the powder filling nozzle of the triple pipe structure of the present invention.

BEST MODE FOR CARRYING OUT THE INVENTION

Figure 1:
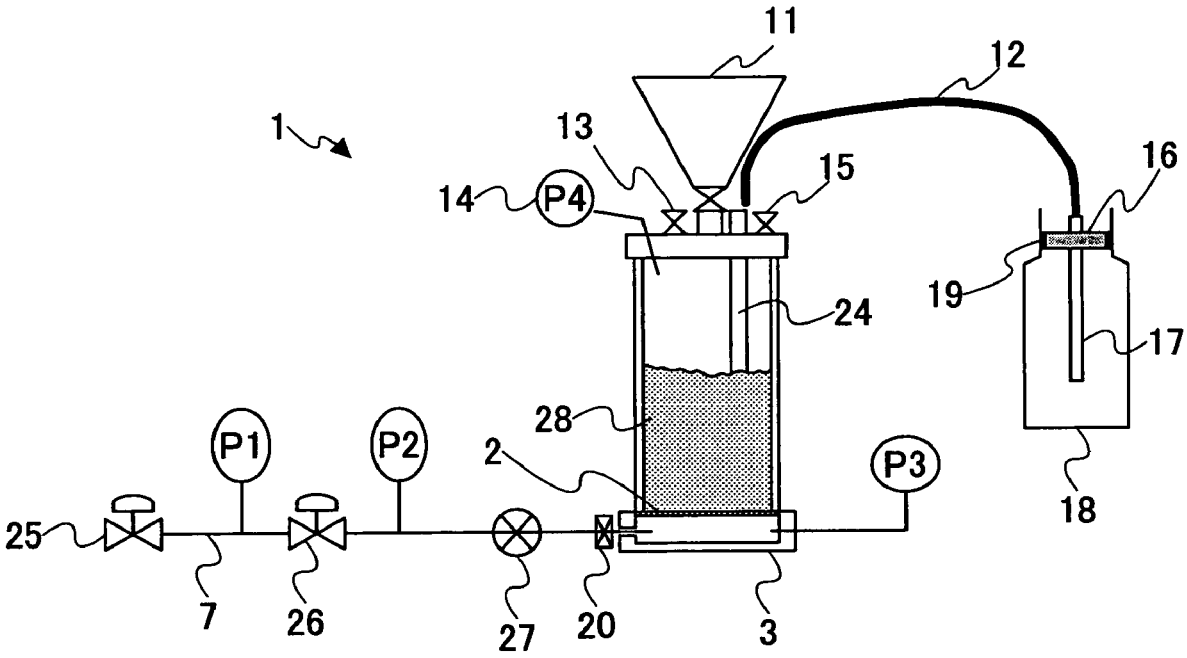
FIG. 1 is a schematic diagram showing the first embodiment of the powder filling device of the present invention.

Before explaining a preferred embodiment of the invention, the powder fluidization unit for solving the above-mentioned problems in the toner filling method which is previously proposed by the inventors will be explained in order to make the understanding of the invention easy.

The proposed powder fluidization unit differs from the method of storing the powder into the container as in the auger type method in which the powder from the powder filling device is agitated and made to fall to the container. In this powder fluidization unit, a minimum quantity of gas is introduced uniformly into the powder within the powder fluidization unit, and a fluidized state of the powder is acquired. After that, the powder in the fluidized state is supplied by pressurization into the container separated from the powder fluidization unit so that the container is filled up with the powder.

The above-mentioned powder fluidization unit will be explained, together with the powder filling device which is an embodiment of the invention, with reference to FIG. 1 and FIG. 2. In FIG. 2, the elements which are the same as the corresponding elements in FIG. 1 are designated by the same reference numerals and have the same meaning.

Figure 2:
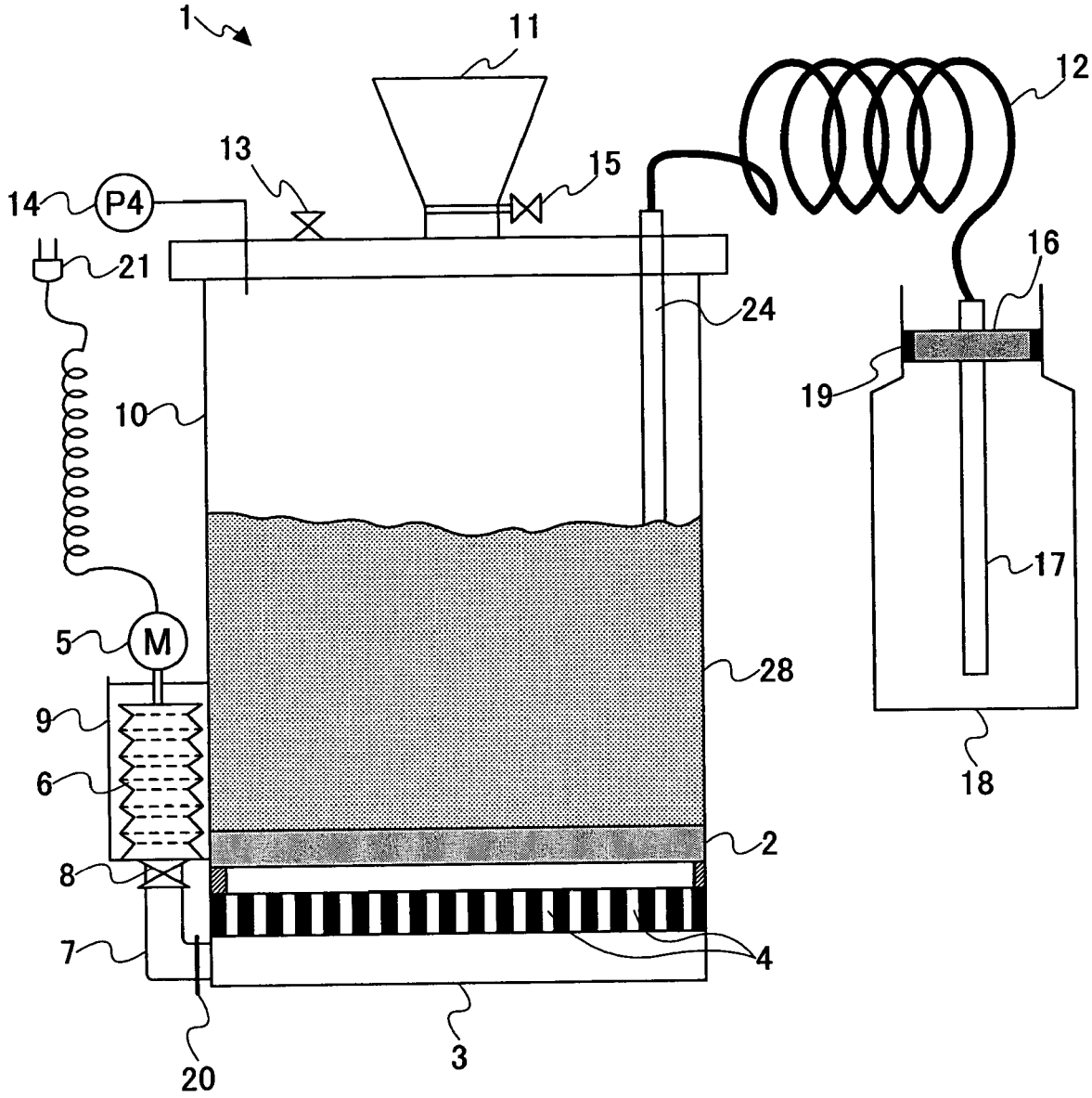
FIG. 2 is a schematic diagram showing the second embodiment of the powder filling device of the present invention.

The main functional devices of the powder filling device shown in FIG. 1 and FIG. 2 are the powder fluidization unit 10 and the powder filling nozzle 17. The powder fluidization unit 10 is hermitically sealed. At the bottom of the powder fluidization unit 10, the air introductory part is provided for fluidizing the powder.

The powder delivery tube 24 is inserted beforehand to the powder fluidization unit 10, one end of the powder delivery tube is connected to the flow powder transport pipe 12, and the other end of the flow powder transport pipe 12 is connected to the powder filling nozzle 17 of the invention.

Furthermore, the other end of the flow powder transport pipe 12 is connected to one end of the powder filling nozzle 17. The other end of the powder filling nozzle 17 which is not connected with the flow powder transport pipe 12 is placed into the container 18 for filling the powder so that the nozzle end does not contact the bottom of the powder container 18.

When the powder filling device operates, the powder to be filled into the container is first injected to the powder fluidization unit 10 from the powder entrance slot 11 with the closing valve, and the pressure open valve 13 for opening and sealing the internal pressure is opened.

On the other hand, the operation of the powder flow velocity control valve 15 for fine adjustment of the pressure may be automated with an electromagnetic valve or carried out by the human power.

After the powder is injected, the pressure open valve 13 is closed, and the gas is introduced from the vent pipe 7 into the air header 3 which is a pressurization accumulator as the gas introducing unit.

The incoming flow of the gas may be adjusted by the first reducing valve 25 and the second reducing valve 26 which serve as the pressure regulation and flow rate adjustment unit. During operation of the powder filling device, the incoming flow is continued.

The introduced gas passes through the ventilation porous plate 2 so that it is distributed uniformly in the powder and the powder is changed into a fluidized state.

While the pressure open valve 13 is closed, the powder 28 in the fluidized state is extruded from the inside of the powder fluidization unit 10 to the powder transport pipe 12 by the pressure of the gas used for the fluidization. The powder in the fluidized state from the end of the tubular filling nozzle 17 is discharged into the container 18. The end of the tubular filling nozzle 17 is placed inside the container 18.

The flow powder transport pipe 12 may be made of a flexible material, and the length of the flow powder transport pipe 12 is not limited to a specific length if only it shows the above-mentioned function. It is possible to arrange the powder fluidization unit 10 and the container 18 so that they are separated from each other.

In the above-described powder filling device, at the initial stage of filling, especially when the inside of the container 18 is completely empty, the degree of opening of the powder flow velocity control valve 15 of the powder fluidization unit 10 is adjusted so that the speed of discharging of the fluidized-state powder from the powder fluidization unit 10 into the container 18 is set to a moderate speed. This is done in order to avoid irregularity or excessive diffusion.

Subsequently, after the quantity of the powder cloud existing in the container 18 increases to such a level that the flow of the fluidized-state powder discharged from the end of the powder filling nozzle 17 can be almost surrounded by the powder cloud, the powder flow velocity control valve 15 is set to a widely open state, and the filling operation is continued.

According to the powder filling method proposed by the inventors, it is possible to eliminate the separation of the external additive from the powder or the generation of the aggregation caused by rotation of the auger as in the auger type method. Moreover, the powder filling device is made small, carrying it is easy, the operation is easy, and it is very effective in eliminating the above-mentioned problems. Therefore it is possible to perform the filling of a small-inlet container or a complicated-shaped container with the powder sufficiently.

According to the powder filling method, the powder in the fluidized state created within the powder fluidization unit is pressurized, and can flow into the container through the transport pipe at high speed. The container can be immediately filled with the powder and the gas. For this reason, in order to fill each of two or more containers with the powder of the given quantity continuously one by one, it is necessary to provide a controllable method so that the incoming flow of the powder is stopped instantly if one container is filled up with the powder of the given quantity, and the incoming flow of the powder or the delivery is resumed for filling the following container with the powder.

If that control cannot be performed enough, the powder is atomized around the powder filling device and the powder stain may occur.

Although the pressure open valve 13 provided in the powder fluidization unit 10 is adjusted and the delivery pressure is controlled, it is found that the feature of stopping the powder flow into the container instantly according to the powder filling method is inadequate.

It is conceivable that the cause of the above problem is that, because a certain time for escaping the air from the pressure open valve is needed, the falling of the residual pressure takes some time and the distance from the powder fluidization unit to the container is too long.

Moreover, the mechanical stop units, such as the valve or the shutter, are provided at the edge of the powder filling nozzle being inserted into the container as the pressure control unit according to the powder filling method. However, as the filling operation is performed repeatedly, the aggregation of the powder is formed. It has been confirmed that the stop control of the powder filling is not performed enough. It is conceivable that the cause of the above problem is that the powder is pressurized by the mechanical stop unit.

In order to solve the above-mentioned problems, the first aspect of the present invention is to provide a powder filling nozzle which realizes the control to stop the delivery of the powder to the container instantly without deteriorating the powder in the powder filling method which acquires the powder in a fluidized state by introducing the gas into the powder flow in the container, and fills up the container with the powder in the fluidized state.

Next, the outline composition of the powder filling nozzle of the invention will be explained.

The powder filling nozzle of the invention is used to fill up the container with the powder mixed with the gas and in the fluidized state, and comprises a tubular body having an opening for discharging the powder in the fluidized state into the container, and a gas separating unit disposed near the opening of the tubular body and allowing the gas delivered together with the powder in the tubular body to pass through the gas separating unit but not allowing the powder to pass through the gas separating unit. The gas separating unit serves to set the opening in a plugged state by the powder separated from the gas so that the delivery of the powder from the tubular body into the container is stopped.

Usually, the powder in the fluidized state delivers well, and it is necessary that in the filling work the discharge of the powder from the powder filling nozzle be stopped instantly if the powder of the given quantity is supplied to the container.

The mechanical pressure is not applied according to the above-described powder filling nozzle of the present embodiment, and the delivery of the powder in the fluidized can be stopped instantly, without separation of the external additive and generation of the aggregation, which may cause the quality of an image formed by the toner for electrophotographic printing to deteriorate. It is possible to efficiently carry out the filling work and accurately control the quantity of the powder being filled into the container.

Next, two examples of the powder filling nozzle of the invention will be explained.

One example is a powder filling nozzle of double pipe structure including a small-diameter tubular body (called first tubular body) and a large-diameter tubular body (called second tubular body). The first tubular body is inserted into the second tubular body, so that a gap between the two tubular bodies is formed as a gas delivery path. Both ends of the two tubular bodies are fixed so as to close the gap.

And the first tubular body serves as a delivery path which discharges the powder in the fluidized state fed from one opening of the first tubular body into the container through the other opening thereof.

The circumference of the neighborhood of the discharge side opening is formed by a filter material which does not pass the powder therethrough but allow the gas to pass therethrough. The second tubular body has a gas exhausting port (called first gas exhausting port) connected with an external gas suction unit (called first gas suction unit).

According to the powder filling nozzle of the double pipe structure of the invention, when the first gas suction unit connected with the first gas exhausting port provided in the second tubular body is operated, the gas, which is flowing with the powder in the first tubular body, passes through the filter material of the first tubular body and is attracted to the first tubular body (not the powder outlet), and a delivery path space is formed between the first tubular body and the second tubular body so that the gas is discharged from the gas exhaust port through the gas delivery path.

Simultaneously, the powder discharged from the first gas exhausting port is attracted around the filter material which is formed on the inner wall of the first tubular body. The plugged state is produced in the filter material by the powder attracted, and, as a result, the delivery of the powder in the first tubular body can be stopped instantly.

Thus, even if the plugged state is produced by the powder attracted in the powder filling nozzle of the present embodiment, there is no undesired influence in the characteristic of powder particles, and even if the powder is the toner, the toner filling work can be carried out without causing the separation of the external additive and the generation of the aggregation.

The double pipe structure type powder filling nozzle of the present embodiment will function effectively when the nozzle is applied to the previously described powder filling method. Namely, the powder in the fluidized state is pressurized and discharged by the powder fluidization unit 10 in FIG. 1 and FIG. 2 passes through the inside of the flow powder transport pipe 12 with the gas, and it is delivered through the inside of the first tubular body of the powder filling nozzle, and it is discharged into the container 18.

In this case, the powder filling nozzle is installed so that one opening of the first tubular body that constitutes the powder filling nozzle is connected to the flow powder transport pipe 12 and the other opening thereof is located near the bottom of the container 18.

Not only the powder but the gas is discharged into the container 18 from the inside of the first tubular body, and it is in the state where the powder and the gas are mixed. The discharged powder is in the state of a comparatively low density within the container when it is filled therein.

In the case in which the powder is the toner for electrophotographic image formation, for the efficiency of transportation of the container products filled up with the toner, filling one container with the toner in a high density state is usually demanded so that the toner can be discharged smoothly from the container for every image formation without causing change of the toner.

In order to fill the powder into the container in a high density state, the de-aeration work which discharges the gas existing between the powder particles in the container is usually done. When the double pipe structure type powder filling nozzle of the present embodiment is used, the gas suction nozzle provided separately is used together, the opening of the gas suction nozzle is installed in the powder in the surrounding condition, and the de-aeration work is performed.

It is preferred that a series of powder filling work is performed as follows. The work which discharges the powder into the container from the powder filling nozzle of the present embodiment is performed initially. If the suction opening of the gas suction nozzle is in a plugged state with the powder, the de-aeration work will be started. In this manner, the discharge of the powder to the container and the de-aeration are performed in parallel temporarily. At the timing that the powder in the container is changed into the high-density state according to the given quantity, the stopping of the discharge of the powder from the powder filling nozzle is performed by operation of the first gas suction unit using the function of the powder filling nozzle of the present embodiment.

Although the stopping of the discharge of the powder is performed instantly, the amount of the powder being discharged can be adjusted by adjusting the suction condition of the first gas suction unit. If the container is filled up with the powder of the given quantity, the container is exchanged with another container. After this, the stopping of the discharge of the powder is canceled and the filling work is continued.

This filling method is applicable to the automation factory where the filling of the plurality of containers with the powder is performed continuously. Moreover, this filling method is also applicable to the field case in which the service man performs individually the filling of the developing device of the customer's image forming device with the toner directly. The application of the present invention is not limited to the above-mentioned ones.

However, when two kinds of nozzles: the powder filling nozzle of the double pipe structure of the present embodiment and the gas suction nozzle are used, it is necessary that the container has two loading slots in which the two nozzles can be inserted separately, or the container has a large loading slot in which the two nozzles can be inserted collectively.

Figure 5B:
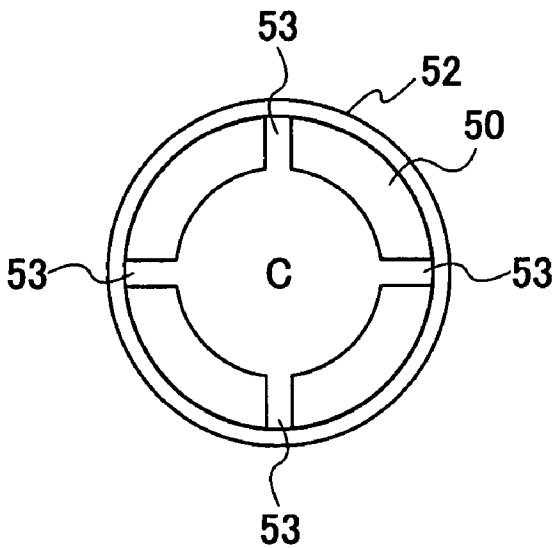
FIG. 5B is a cross-sectional view of the first tubular body of the powder filling nozzle of FIG. 5A taken along the line B-B.
Figure 5A:
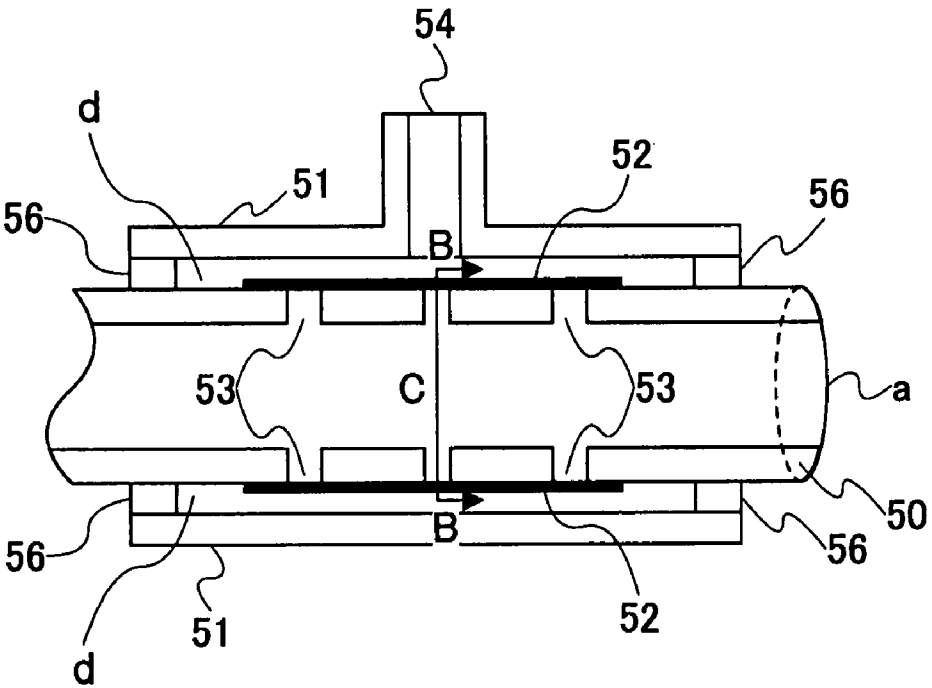
FIG. 5A is a cross-sectional view showing the modification of the powder filling nozzle of the double pipe structure of the present invention.

FIG. 5A shows the modification of the powder filling nozzle of double pipe structure. FIG. 5B is a cross-sectional view of the first tubular body of the powder filling nozzle of FIG. 5A taken along the line B-B in FIG. 5A.

The powder filling nozzle of FIG. 5A comprises the through holes 53 formed in the pipe wall of the tubular body 50 near the end of the tubular body 50, and the gas separation unit 52 (a filter part) provided near the through holes 53 for separating the gas from the fluidized-state powder which is made of the powder particles and the gas being delivered through the space c in the tubular body 50.

The enclosure 51 is provided on the outside of the tubular body 50 with sealing nature so that the gas separation unit 53 is surrounded by the enclosure 51. The sealing nature of the space d is maintained by disposing the sealing member 56 between the pipe walls of the enclosure 51 and the tubular body 50.

The enclosure 51 having the sealing nature may be constituted so that the enclosure 51 has the opening 54 connected with a gas suction unit (not illustrated).

The powder filling nozzle of the triple pipe structure will be explained by using an example of the powder filling nozzle used to fill a fluidized-state powder into a container which does not meet such conditions according to the new powder filling method.

The powder filling nozzle of the triple pipe structure according to the invention is arranged such that another tubular body (called the third tubular body) having an inner diameter larger than the outer diameter of the second tubular body surround the second tubular body of the powder filling nozzle of the double pipe structure. Namely, the powder filling nozzle of the double pipe structure is inserted in and fixed to the third tubular body.

And the filter part which allows the passing of the gas through the filter part is disposed in the circumference of the third tubular body near the opening of the third tubular body, located on the outlet side of the first tubular body where the powder is discharged. Further the third tubular body is provided with a gas exhausting port (called the second gas exhausting port) connected with an external gas suction unit (called the second gas suction unit).

The functions of the first tubular body and the second tubular body in the powder filling nozzle of the triple pipe structure are the same as those in the case of the powder filling nozzle of the double pipe structure. The powder filling nozzle of the triple pipe structure is arranged so that the opening at one end of the first tubular body is connected with the flow powder transport pipe and the filter part at the other end of the third tubular body is surrounded by the powder.

When the powder is discharged into the container and the filter part of the third tubular body is in a state in which the filter part is surrounded by the powder, the second gas suction unit is operated, the gas existing between the powder particles is attracted and passed through the space formed as the gas delivery path between the second tubular body and the third tubular body, so that the gas is discharged from the second gas exhausting port.

In this manner, according to the powder filling nozzle of the triple pipe structure, the powder can be filled into the container with high density, similar to the case in which the powder filling nozzle of the double pipe structure is used.

The new powder filling method which is represented by the powder filling nozzles of the double pipe structure and the triple pipe structure described above, as well as the powder filling device in which the powder filling nozzle of the invention is provided also constitutes the present invention. The powder filling method and device will now be explained.

As previously, in the new powder filling method which carries out the delivery of the powder in the fluidized state, it is preferred to make the powder in the fluidized state uniform by a control unit which adjusts the introduction gas pressure by the introductory gas control valve, adjusts and controls the pressure of the gas in the hermitically sealed powder fluidization unit (powder logging unit), and introduces the gas to the powder in the powder fluidization unit (powder logging unit) uniformly.

By using the uniform gas introduction unit mentioned above, the gas (air) is introduced into the powder fluidization unit gently so that the fluidization of the powder in the required necessary amount can be attained with suppression of the Brownian motion of the powder particles.

The powder in the fluidized state has a high mobility, and, only if the pressure in the powder fluidization unit is made slightly higher than the external pressure, the powder can be discharged out of the powder fluidization unit, and the delivery of the powder through the transfer passage to the end of the powder filling nozzle is smoothly carried out. And the filling of the powder into the container is carried out without causing excessive churning in the container In the present invention, when the powder filling device is constructed to the structure in which the board made of a sintered resin (product name: "Firutaren") is interposed between the acrylic cylinder and the bottom flange as a ventilation porous plate, the most suitable result is obtained. Therefore, the case in which the sintered resin board (product name: "Firutaren") is used to maintain a stable flow state and a homogeneous powder will be explained below.

Although the Gore-Tex, a sintered metal plate, etc. may be used instead as a ventilation porous plate, the case in which the sintered resin board "Firutaren" is used as a ventilation porous plate for such a purpose demonstrates the most uniform air flow.

When fluidizing the powder with the gas and the gas is introduced from the outside of the powder fluidization unit only not using the gas of the powder fluidization unit, it is important to introduce the gas uniformly. For that purpose, it is preferred to use a gas dispensing unit, such as a fine wire net, which does not produce a large head pressure loss, so that the gas is introduced through the gas dispensing unit.

The control of starting and stopping the filling operation to fill the fluidized-state powder into the container is carried out by regulating the pressure open valve provided in the powder fluidization unit to adjust promptly the pressure in the powder fluidization unit. In addition, an external pressure unit may be used to help this control.

The powder filling can be operated by changing the pressure in the powder fluidization unit and/or the powder exhaust passage by the powder flow velocity control valve which is provided independently and is suitable for pressure fine tuning, and the pressure fine tuning to which the outflow state of the powder is changed in the middle of the powder filling operation can also be performed further.

In the present invention, after the powder is fluidized with the gas by swinging the powder storage device enclosed and sealed, the inside of the powder storage device can be pressurized. The pressurization of the powder storage device is performed by decreasing the internal volume of the powder storage device using the external pressure. For example, the internal volume of the powder storage device is decreased by depressing it, the powder is discharged out of the powder storage device, and the powder is delivered to the end of the powder filling nozzle, so that the powder is filled into the container.

According to this method, the device for fluidizing the powder can be omitted or the miniaturization of the powder filling device can be achieved.

The powder storage device may have a size and weight so that it can be shaken by the human hands, and may have a size and weight which can be easily vibrated or rocked with the pump power for pressurization air introduction.

The powder storage device which is miniaturized can be used also as a consumable, simple powder filling device by performing the weighing of the required quantity beforehand.

The powder in the fluidized state is delivered to the end of the powder filling nozzle and discharged into the container from the powder filling nozzle, and the discharging of the powder is stopped instantly by the function of the powder filling nozzle of the invention. As described above, the amount of discharge of the powder can be adjusted by adjusting the suction pressure with the first gas suction unit.

Moreover, the adjustment of the amount of discharge of the powder can also be performed by using together the introductory gas control valve of the powder fluidization unit in addition to the powder discharge stopping function of the powder filling nozzle. Thus, it is possible for the present invention to fill the powder of the given quantity into the container with high density.

Next, the examples of the powder filling nozzle of the invention will be explained using FIG. 3, FIG. 4A, and FIG. 4B. However, the present invention is not limited to these figures. A description will be given of the example in which the filling of a toner for electrophotographic printing is performed by using the powder filling nozzle of the invention, which demonstrates the most suitable result.

Figure 3:
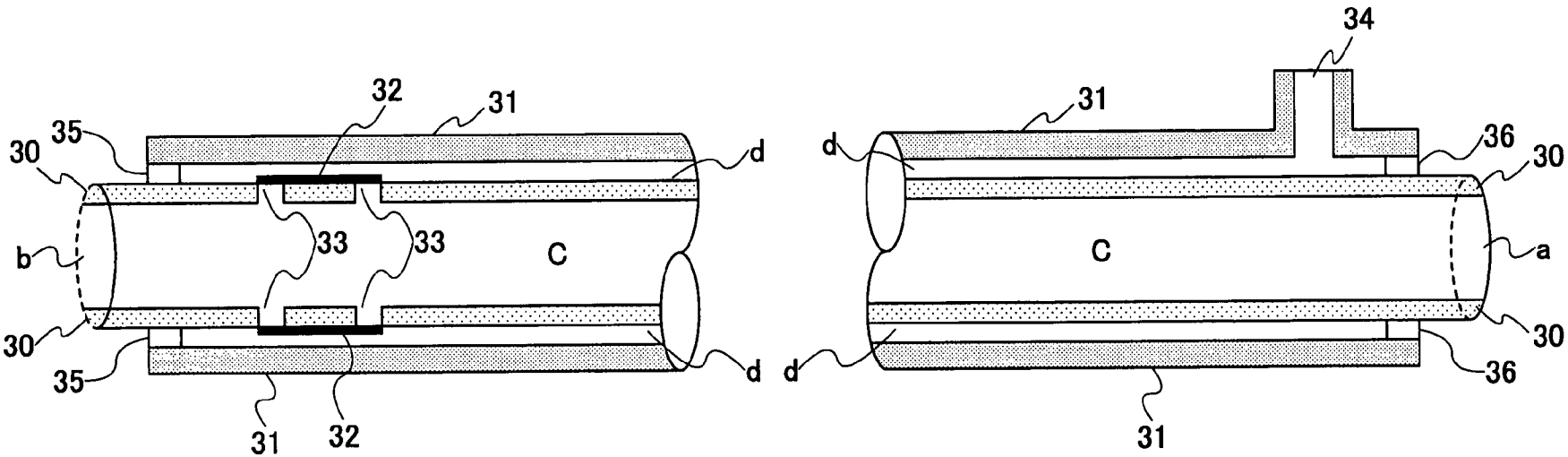
FIG. 3 is a cross-sectional view showing an example of the powder filling nozzle of the double pipe structure of the present invention.

FIG. 3 is a cross-sectional view showing an example of the powder filling nozzle of double pipe structure.

As shown in FIG. 3, the powder filling nozzle of the double pipe structure comprises the first tubular body 30 and the second tubular body 31, the second tubular body 31 having a length slightly smaller than the length of the first tubular body 30. The powder in the fluidized state is fed from the opening a of the first tubular body 30, passes along the space c, and is discharged into the container from the opening b.

The through holes 33 are formed near the opening b of the first tubular body 30 where the powder is discharged. The filter material is wound around the circumference of the first tubular body 30 to cover the through holes 33. The filter part 32 having the quantity of mesh, corresponding to the toner's average-volume particle diameter of 10 micrometers or less (which is, for example, a 3500-mesh metallic filter or sintered glass filter) is formed to cover the through holes 33.

The outer diameter of the first tubular body 30 is smaller than the inner diameter of the second tubular body 31. The first tubular body 30 is inserted in the second tubular body 31 and arranged so that the space d is formed between the two tubular bodies, and both ends of the second tubular body 31 are fixed to the first tubular body 31 so as to close the space d with the holding materials 35 and 36.

The gas exhausting port 34 which is connected with an external gas suction unit is formed near the end of the second tubular body 31 which is located on the side of the opening of the first tubular body 30 where the powder is flowed in.

When the first gas suction unit is operated, the powder and the gas which are delivered in the first tubular body 30 are attracted. The gas is allowed to pass through the filter part 32, and it is delivered along the space d and discharged from the gas exhausting port 34. On the other hand, the powder does not pass through the filter part 32 but is attracted to the filter part 32 provided on the circumference of the first tubular body 30, so that the filter part 32 serves to set the through holes 33 in a plugged state in which the first tubular body 30 is blocked with the powder.

In this way, the delivery of the powder in the first tubular body 30 is stopped instantly.

It is preferred that the gas suction pressure by the first gas suction unit is in the range of −10 to −60 kPa. And it is more preferred that the gas suction pressure is in the range of −30 to −45 kPa.

It is preferred that the powder is delivered while the internal pressure and the delivery speed are adjusted so that the bulk density of the powder inside the first tubular body 30 is in the range of 0.1 to 0.2. Especially, in order to avoid lowering the powder quality and stop the delivery of the powder instantly, it is desirable that the suction pressure by the first gas suction unit is adjusted so that the bulk density of the powder when the through holes 33 are set in the plugged state is in the range of 0.4 to 0.5.

Figure 4A:
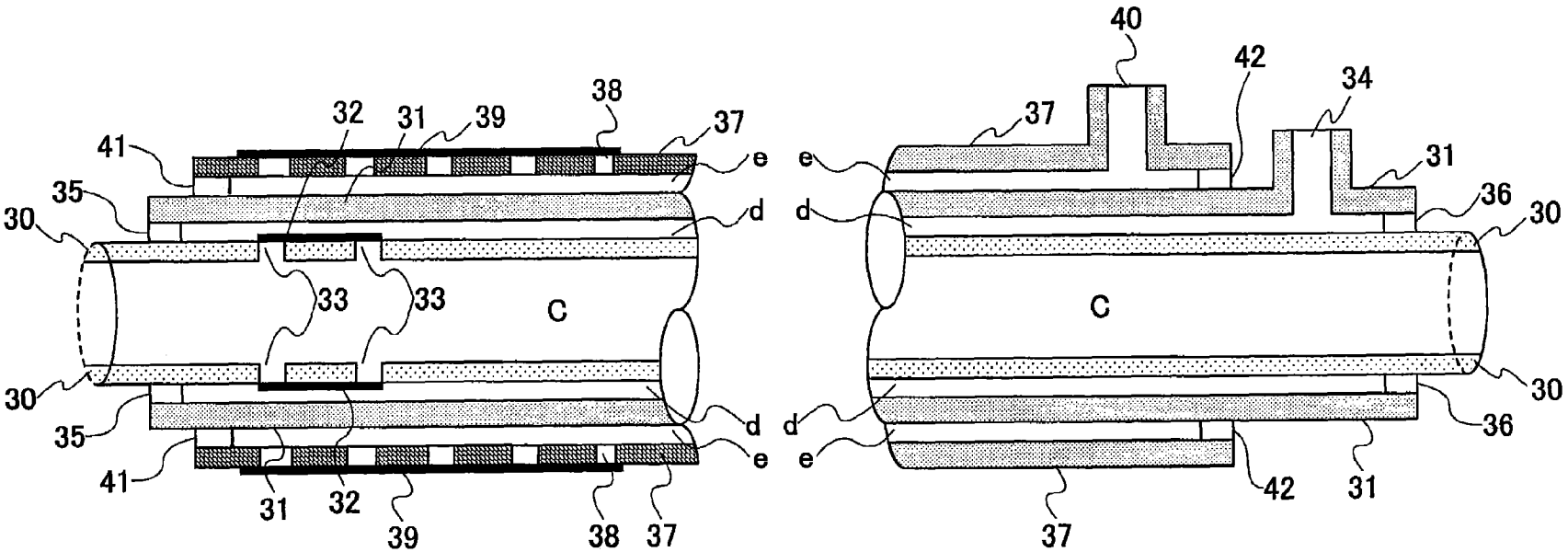
FIG. 4A is a cross-sectional view showing an example of the powder filling nozzle of the triple pipe structure of the present invention.

Next, FIG. 4A is a cross-sectional view showing an example of the powder filling nozzle of the triple pipe structure.

As shown in FIG. 4A, the powder filling nozzle of the triple pipe structure is constructed such that the third tubular body 37 having the inner diameter larger than the outer diameter of the second tubular body 31 is used, and the powder filling nozzle of the double pipe structure is inserted in the third tubular body 37. The space e is formed between the second tubular body 31 and the third tubular body 37, and both ends of the third tubular body 37 are fixed to the second tubular body 31 so as to close the space e with the holding materials 41 and 42.

The through holes 38 are formed near the end of the third tubular body 37 on the side of the opening b of the first tubular body 30 where the powder is discharged. The filter part 39 having the filter material which is wound around the circumference of the third tubular body 37 is formed to cover the through holes 38.

Figure 4B:
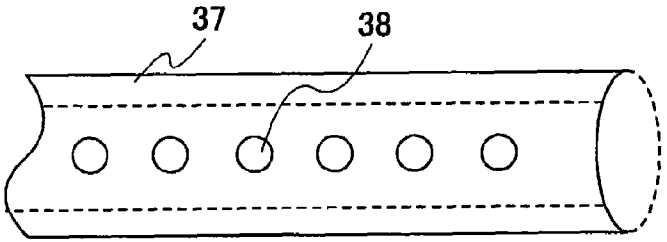
FIG. 4B is a diagram showing the third tubular body with two or more through holes formed in the powder filling nozzle.

FIG. 4B shows the through holes 38 provided above the first tubular body 30.

As shown in FIG. 4B, the gas exhausting port 40 which is connected with a second external gas suction unit is provided near the end of the third tubular body 37 on the side of the opening a of the first tubular body 30 where the powder is flowed in.

The functions and composition of the first tubular body 30 and the second tubular body 31 in the powder filling nozzle of the triple pipe structure are the same as those in the powder filling nozzle of the double pipe structure.

In the powder filling nozzle of the triple pipe structure, when the second gas suction unit is operated, the powder and the gas which are discharged in the container are attracted. The gas is allowed to pass through the filter part 39, and it is delivered along the space e and discharged from the gas exhausting port 40. On the other hand, the powder remains without passing through the filter part 39, and it is finally filled into the container with a high-density state.

It is preferred that the gas suction pressure by the second gas suction unit is in the range of −10 to −60 kPa. And it is more preferred that the gas suction process is in the range of −20 to −35 kPa.

The first tubular body, the second tubular body, and the third tubular body which constitute the powder filling nozzle will be explained.

For each of these tubular bodies, a long pipe type is usually used. Each tubular body may be made of a metal, such as stainless steel, titanium and aluminum, or made of a plastic material.

The length of each tubular body is not restricted to a specific length. However, it is usually preferred that the first tubular body is the longest one, the second tubular body is the second longest one, and the third tubular body is the shortest one. This feature is desired for the sake of functionality and processability of the powder filling nozzle.

If the desired function is demonstrated, the thickness of each tubular body is not restricted to a specific thickness. However, it is preferred that the outer diameter of the first tubular body is in the range of 4 to 20 mm.

Especially the length and thickness of each of the first tubular body, the second tubular body, and the third tubular body, and the space width formed between these tubular bodies are important elements in order to demonstrate the functions of the powder filling nozzle of the present invention. It is preferred that the following conditions (1) to (5) are satisfied simultaneously:

(1) The outer diameter of the first tubular body/the length of the first tubular body: 65-85;

(2) The outer diameter of the second tubular body/the length of the second tubular body: 55-75;

(3) The outer diameter of the third tubular body/the length of the third tubular body: 40-46;

(4) The outer diameter of the first tubular body/the inner diameter of the second tubular body: 1.05-1.3; and (5) The outer diameter of the second tubular body/the inner diameter of the third tubular body: 1.08-1.5.

The filter part which is provided for the powder flow stopping is disposed on the circumference of the first tubular body in the neighborhood of the outlet of the first tubular body in the powder filling nozzle of the invention.

The term "neighborhood", which indicates the location where the filter part is disposed, means that, in order to sufficiently achieve the function of stopping the powder discharging flow in the first tubular body, it is desired to dispose the filter part at a location which is not exactly the same as the outlet of the first tubular body. It is preferred to dispose the filter part at a location which is distant from the outlet in the range of 5 to 25 mm.

It is preferred that the width of the filter part is more than 0.3 times the inner diameter of the powder discharge outlet opening of the first tubular body. Specifically, it is preferred that the width of the filter part is in the range of 4 to 20 mm.

Next, the two methods of forming the filter part will be explained.

One method is as shown in FIG. 3 and FIG. 4A. According to this method, the through holes are formed in the first tubular body near the end thereof used as the outlet of the first tubular body, and the filter material is wound around the circumference of the first tubular body where the through are formed to cover the through holes. In this manner, the filter part is formed.

This method is to form the through holes in the first tubular body itself, and it is aimed at obtaining good operability of the nozzle with the straightness, toughness of the nozzle, processability of winding the filter material, etc.

The size of the through holes is not restricted to a specific size. However, it is preferred that the size of the through holes is less than ⅔ of the inner diameter of the first tubular body. It is preferred to provide two or more through holes in a row in the length direction of the tubular body. And it is more preferred to provide the through holes in the length direction of the tubular body in two or more rows and two or more columns.

The other method is that the first tubular body is made from a tubular body having a lamination structure in which a tubular member made of a filter material and a tubular member made of a non-filter material are bonded together, and the tubular member of the filter material is made to serve as the filter part. This method is aimed at reducing the clogging of the powder in the filter part.

It is essentially necessary that the filter part allows only the gas to pass through the filter part but does not pass the powder, when it is attracted by the gas suction unit. The filter material of the filter part is not restricted if this function is demonstrated.

As the filter material, it is important to select the mesh filter material. A lamination object in which different filter materials of two or more kinds of the mesh are laminated can be used as the filter material. It is preferred that the lamination object is comprised of a coarse-mesh filter material on the outside, and a fine-mesh filter material on the inside. The use of this lamination object is preferably applicable to the latter method mentioned above, which shows a comparatively low toughness of the filter part.

When compared with the filter part made of a plain weave filter material, the filter part made of a twill-weave filter material has a smaller filtration particle size and a higher surface smoothness. The filter part made of a twill-weave filter material is more suitable for the gas separating unit in the powder filling nozzle of the invention pass, because it demonstrates the function of the filter material that allows the gas to pass through the filter part but does not allow the powder to pass through the filter part.

It is preferred to select the thickness of the filter material in consideration of the narrow space formed between the first tubular body and the second tubular body.

In the powder filling nozzle of the triple pipe structure of the invention, a filter part for gas suction is disposed on the circumference of the third tubular body in the neighborhood of the outlet of the powder filling nozzle where the powder is discharged.

The term "neighborhood", which indicates the location where the filter part is disposed, means that, in order to sufficiently achieve the function of gas suction of the container inside, it is desired to dispose the filter part at a location which is exactly the same as the outlet of the powder filling nozzle. It is preferred to dispose the filter part at a location which is distant from the outlet in the range of 5 to 15 mm.

Since it is necessary to discharge a lot of gas, it is preferred that the width of the filter part is larger than the width of the filter part of the first tubular body, and it is preferred that the width of the filter part concerned is in the range of 50 to 150 mm.

The formation method and material of this filter part are essentially the same as those in the case of the first tubular body.

The first tubular body is differed from and it is a filter part. When following the method of providing and forming a through hole in the tubular body itself, as for a through hole, it is preferred that the path is ⅔ or less of the inner diameter of the third tubular body, and it is preferred to provide two or more rows of desirable still such providing in the machine direction of the tubular body in four or more rows and four or more columns.

As for the position which is provided in each of the second tubular body that constitutes the powder filling nozzle of the present invention, and the third tubular body and in which the first gas exhausting port and the second gas exhausting port are provided, it is preferred that they arrange and install near where the fluidized-state powder of the first tubular body flows in the opening although both sides are not restrictive.

The diameter of the powder discharge outlet for both the cases is not restricted to a specific diameter. However, it is preferred that the diameter of the powder discharge outlet is in the range of 4 to 7 mm.

Each of the gas suction units which are connected to the first gas exhausting port and the second gas exhausting port, respectively may be of a vacuum pump suction type, an ejector mechanism suction type, etc. Among them, the ejector mechanism suction type is more suitable since it hardly needs maintenance.

The holding materials for preventing gas leakage and fixing the space formed between the ends of the second tubular body near the end of the first tubular body, and the space formed between the ends of the third tubular body near the end of the second tubular body, may be made of a ring shape holding material, a binding material, solder, etc.

Next, the powder filling device of the invention in which the above-described powder filling nozzle of the triple pipe structures is provided will be explained using FIG. 1 and FIG. 2. However, the powder filling device of the invention is not limited to these figures.

In a case where the powder filling device of the invention is constructed with the powder filling nozzle of the double pipe structure which is not illustrated, two separate gas suction nozzles are prepared, and the two nozzles are respectively inserted in a container having two loading slots or collectively inserted in a container having a larger loading slot provided to receive both the two nozzles.

In the powder filling device of FIG. 1 and FIG. 2, the elements in FIG. 2 which are the same as corresponding elements in FIG. 1 are designated by the same reference numerals and have the same meaning.

In the powder filling device shown in FIG. 1 and FIG. 2, the powder fluidization unit 10 with which the air introductory part is disposed on the bottom for powder fluidization is provided. In the powder fluidization unit 10, the powder delivery tube 24 is inserted beforehand, and one end of the powder delivery tube 24 is connected with the flow powder transport pipe 12, and the end of the flow powder transport pipe 12 which is not connected with the powder delivery tube 24 is connected with the powder filling nozzle 17 of the triple pipe structure of the invention.

The end of the powder filling nozzle 17 on the side where it is not connected with the flow powder transport pipe 12 is inserted in the inside of the container 18 for powder filling so that it does not contact the bottom of the container 18.

The air header 3 has some resistance to the pressure such that the air header 3 is capable of increasing the internal pressure of the powder fluidization unit 10. The air header 3 is provided with the third pressure gauge p3.

The first reducing valve 25, the second reducing valve 26, and the air flow meter 27 are disposed in this order in the compressed air piping 7 linked to the air header 3. The first pressure gauge p1 is disposed between the first reducing valve 25 and the second reducing valve 26, and the second pressure gauge p2 is disposed between the second reducing valve 26 and the air flow meter 27, respectively.

When the powder filling device is set to work, the powder which is being filled into the container is first loaded in the powder fluidization unit 10 from the powder entrance slot 11 with the closing valve, and the pressure open valve 13 for opening and closing the internal pressure is opened.

On the other hand, operation of the powder flow velocity control valve 15 for pressure tuning may be automated with an electromagnetic valve or performed by the human power.

After the powder is loaded, the pressure open valve 13 is closed, and the gas is introduced from the vent pipe 7 into the air header 3 which is a pressurization accumulator as the gas introducing unit. The incoming flow of the gas may be adjusted by the first reducing valve 25 and the second reducing valve 26 which serve as the pressure regulation and flow rate adjustment unit. During operation, the incoming flow of the gas is continued. The introduced gas is passed through the ventilation porous plate 2 and distributed in the powder uniformly, so that the powder is fluidized with the introduced gas.

The introduced gas is uniformly distributed in the powder by the ventilation porous plate 2, and the powder is fluidized with the gas. While the pressure open valve 13 is closed, the fluidized-stated powder is extruded to the powder transport pipe 12 from the inside of the powder fluidization unit 10 by the pressure of the gas which is used for the fluidization. The powder is discharged into the container 18 from the end of the powder filling nozzle 17 of the invention inserted in the inside of the container 18.

The end of the powder filling nozzle 17 is inserted in the container so that it does not contact the bottom of the container. The vent pipe 7 may be made of a flexible material and the length of the vent pipe 7 is not limited if it exhibits the intended function. Thus, the powder fluidization unit 10 and the container 18 can be arranged at separate locations which are distant from each other.

The flow powder transport pipe 12 may be made of a flexible material and the length of the flow powder transport pipe 12 is not limited if only it exhibits the intended function. Thus, the powder fluidization unit 10 and the container 18 can be arranged at separate locations which are distant from each other.

In the container, a lot of gas is discharged together with the powder, and the inside of the container is mostly divided into the upper layer part in which only the gas exists and the lower layer part in which the powder and the gas are mixed.

In order to discharge the gas of the upper layer part, the lid member attached to the inlet part of the container 18 is provided with at least the powder-gas separation screen (ventilation porous plate) 16. The gas of the upper layer part is discharged from this vent hole, and the pressure in the container is adjusted.

The lid member has a size that can fit into the opening of the container for powder filling, is made of a ventilation porous material, and has a hole for inserting the powder filling nozzle. The lid member the circumference of which is surrounded by an elastic packing may be used to increase the fitting characteristic.

In the case of the powder filling nozzle of the triple pipe structure, the de-aeration about the gas existing between the powder particles of the lower layer part is performed by operation of the second gas suction unit which is externally disposed and connected with the second gas exhausting port provided in the third tubular body.

In the case of the powder filling nozzle of the double pipe structure, the de-aeration is performed by operation of the second gas suction unit using the gas suction nozzle inserted into the powder in the container as disclosed in Japanese Laid-Open Patent Application No. 2001-31002.

In the powder filling device of FIG. 1 and FIG. 2, at the beginning of filling when the inside of the container 18 for powder filling is completely empty, the degree of opening and closing of the powder flow velocity control valve 15 of the powder fluidization unit 10 is adjusted, so that the powder discharge speed from the powder fluidization unit 10 is initially decreased. Thus, the irregularity or diffusion inside the container 18 in which the fluidized-state powder is filled is avoided.

Next, after the quantity of the fine powder particle clouds staying in the container 18 increases so that it is surrounded mostly by the fluidized-state powder flow discharged from the end of the powder filling nozzle 17, the powder flow velocity control valve 15 is adjusted to an increased opening position and the filling operation is continued.

The filling nozzle 17 is put on the filling port upper part of container 18 for powder filling, may be automatically inserted in container 18 inside for powder filling after the set of container 18 for powder filling, or may be inserted manually.

Alternatively, another method may be used in which the lid member is placed on the top of the powder filling nozzle to be fixed in the state where it is inserted in the hole, near the connection part of the flow powder transport pipe and the filling nozzle, to attach the container to the lid member, to exchange the container after powder filling, and to fill up many containers with the powder one by one.

The lid member may be removed from the container when the container is filled and delivery stopped.

And working the first gas suction unit connected with the first tubular body that constitutes the powder filling nozzle of the triple pipe structure, although not illustrated, the delivery of the powder into the inside of the first tubular body is stopped, and the discharge of the powder into the container can be stopped.

The stopping of the powder discharge can also be performed while the opening of the pressure open valve 13 of the powder fluidization unit 10 and the operation of the gas suction unit are performed in parallel. If the pressure open valve 13 is opened somewhat so that the internal pressure in the powder fluidization unit 10 used as the powder transport force is reduced, the powder delivery stopping can be performed effectively.

In the powder filling device 1 of FIG. 2, the ventilation porous plate 2 (a sintered metal plate, a sintered resin board, a fine-tooth wire net, etc.) is detachably attached via the flange to the lower part of the powder fluidization unit 10 made of a flexible material, such as a flexible plastic, and the air may pass through the ventilation porous plate 2 for forming the fluidized state powder flow.

Moreover, the powder filling device 1 of FIG. 2 further comprises the compressed air piping as the vent pipe 7, the air header 3 as the gas introducing unit with the vent pipe 7 being detachably attached, the powder entrance slot 11 with the closing valve, the pressure open valve 13 for opening and sealing of the internal pressure, the powder flow velocity control valve 15 for pressure fine tuning, the stainless steel pipe as the flow powder delivery tube 24, and the urethane inner tube as the exhaust passage (transfer passage) 12 which is detachably attached. The gas powder separation screen 16 having a diameter that can be fitted to the mouth part of the container 18 is provided on the base of the powder filling nozzle 17 made of the stainless steel and detachably attached to the exhaust passage 12 (urethane tube).

In this example, the gas powder separation screen 16 has the circumference which is surrounded by the elastic packing 19 which is made of a polypropylene ring in the shape of a truncated cone.

However, unlike the powder filling device of FIG. 1, the powder filling device of FIG. 2 has the check valve 8 disposed at the gas outlet as a gas introducing unit, and the pump 6 provided to supply the air to the air header 3. The pump 6 is made in the bellows structure which is expanded and contracted by the small electric motor 5.

The pump 6 is detachably fixed in the holding frame 9. When the pump 6 is expanded and contracted by the small electric motor 5, the powder fluidization unit 10 is vibrated through the holding frame 9, so that the powder in the powder fluidization unit 10 is fluidized with the gas by this vibration.

In the powder filling device of FIG. 2, it is not necessary to construct the powder fluidization unit 10 and the air header 3 by a thick material, and the weight saving and miniaturization of the whole device can be promoted further. The powder filling device can be operated only by inserting the plug 21 for power supply of the small electric motor 5 into the electric socket provided in the copying machine.

The powder filling device needs little power consumption when compared with the case of the auger-type filling device which is conventionally used, and it can be operated with 100V power supply for home use, not with 200V power supply for industrial use.

However, if it usually depends only on the electric power, as a reduction level of an environmental impact, there is not a great difference between the 100V case and the 200V case. Then, using natural power sources as the source of power for working the powder filling device is also set to one embodiment of the present invention.

The electric energy as used in the present invention means the electric power supplied to the office, the home, etc. with the power supply line from the electric power company.

On the other hand, natural power sources mean the electric power other than the electric power built in the electric power company, and is made from its own house, and, specifically, have pointed out the electric power obtained by sunlight energy (solar-powered electricity generation) and wind power energy (wind power exothermic system).

Natural power sources are the sunlight energy and wind power energy which can be obtained concrete anywhere, and the geothermal energy which cannot be obtained easily is excepted.

For example, the conversion of the sunlight energy to the electrical energy is carried out using a solar cell as follows. In this solar cell, the light from the sun is irradiated to the connection part of the connection of the p-type semiconductor and the n type semiconductor, such as silicon, and the electrical energy of direct current is outputted from the semiconductor solar cell.

The conversion of the wind power energy to the electrical energy is carried out as follows. For example, 1-3 wind vanes are rotated with the wind force, this rotation is transmitted to the rotary coil arranged between the N pole and the S pole, and the d.c. or a.c. current is obtained.

Suppose that the sunlight electrode unit and the two wind turbine generators are prepared. The electric generating capacity of sunlight is 3 kW, the electric generating capacity of one of the two wind turbine generators is 60 W, and the electric generating capacity of the other wind turbine generator is 72 W.

Using the powder filling nozzle and the sunlight electrode unit and the two wind turbine generators, the powder is filled into 100 toner containers (the capacity is 1560 ml), and the results of filling the toner containers with the powder in summer and in winter are compared with the normal case in which only the commercial electric power 100V is used without using the natural power source as follows.

Powder filling in summer: minimum temperature 20 degrees C., maximum temperature 35 degrees C., average wind speed 5 m/s, weather fine.

Powder filling in winter: minimum temperature 5 degrees C., maximum temperature 15 degrees C., average wind speed 10 m/s, weather cloudy.

In the case of the summer time powder filling, the amount of the commercial electric power used is one fifth of that in the normal case. In the case of the winter time powder filling, the amount of the commercial electric power used is one third of that in the normal case. The amount of carbon dioxide generated is ⅕ or less of that in the normal case in which only the commercial electric power 100V is used, and the influence to the environment is remarkably reduced.

In another embodiment of the powder filling device of the invention which is not illustrated, the powder is mixed the gas and fluidized, and the container is made from a flexible plastic material, such as polyethylene, which is capable of being deformed easily by the human power, and the container is formed into an airtight container with one piping connection mouth. The external pressure is applied so that the plastic container is deformed, and the internal pressure is increased using the urethane inner tube connected to the piping connection mouth. The powder may be distributed to the bottom of the container using the urethane inner tube.

Alternatively, at least two piping connection mouths are provided in a non-deformable container which is made of a rigid plastic. And the piping of the compressed air of 0.2 MPa or less is connected to one of the connection mouths of the container, and the other connection mouth serves as a powder transport pipe, and the powder is supplied to the container bottom through the inner tube.

As the source of the compressed air, not only the usual compressor but also the inflator of manual operation for a bicycle may be used.

As described above, the powder may be discharged from the powder fluidization unit 10 to the powder filling nozzle 17 by raising the pressure in the powder fluidization unit 10. Alternatively, the same may be carried out by applying the external pressure to the powder fluidization unit 10 and decreasing the internal volume of the powder fluidization unit 10.

The powder for use in the powder filling device and powder filling nozzle of the invention is not restricted to a specific powder. However, it is effective if it is applied to the toner for electrostatic latent image development regardless of the toner kind. It is possible to effectively use the toner whose average particle diameter is in the range of 0.2 to 20 micrometers, in the range of 5 to 15 micrometers, and in the range of 7 to 12 micrometers.

The container 18 applied to the present powder filling device for powder filling is not restricted. For example, the container for electrophotographic image formation of a bottle or cartridge type which is made of a resin, such as polyethylene or polyester can be suitably used.

The container configuration may be various, such as a cylinder type, a polygon, and other configurations. For example, when a cylinder type container is used, the diameter of the container may be in the range of 10 to 300 mm, and the length of the container may be in the range of 50 to 2000 mm.

Next, the results of the experiments which are performed according to the powder filling methods of the respective embodiments in which the powder filling nozzle of the invention is used and according to the comparative examples will be described. However, the present invention is not limited by this case of the operation.

(1) The Check of the Powder Delivery Stopping Function of the Powder Filling Nozzle of the Present Invention The powder filling device used for the experiment will be explained based on the powder filling device 1 shown in FIG. 1 and FIG. 2.

The powder fluidization unit 10 used for the experiment has a generally cylindrical configuration with the capacity of 200 liters. The powder fluidization unit 10 is provided at the bottom with the ventilation porous plate 2 which is made of a porous plate-like resin material with the void diameter of 10 micrometers, the porosity of 30%, and the thickness of 5 mm.

The powder delivery tube 24 in the powder fluidization unit 10 and the end of the powder filling nozzle of double pipe structure are connected together via the flow powder transport pipe 12. The powder filling nozzle is passed through the hole provided in the lid member including the ventilation porous plate 16 made of resin, and inserted into the powder storage container 18.

The container of the toner powder used for the experiment is made of a polyester resin, and this container has the interval volume of about 1560 cc, the diameter of about 100 mm, and the length of about 200 mm, and the opening where the powder filling nozzle is inserted has the diameter of about 20 mm.

(2) Discharge of the Toner to the Container

As a toner powder, the Type 8000 toner or Ricoh color laser printers (the average volume particle diameter: 7 micrometers and the specific gravity: 1.2) is prepared, and the 60 kg of toner is fed into the powder fluidization unit 10 from the powder entrance slot 11 in the powder fluidization unit 10 while the powder flow velocity control valve 15 is adjusted.

Next, while the pressure open valve 13 provided near the powder entrance slot 11 of the powder fluidization unit 10 is adjusted, the delivery pressure is adjusted through the two steps of reducing valves: the first reducing valve 25 and the second reducing valve 26 from the compressed air source. The air is delivered to the air header 3 for 5 minutes at a rate of 30 liters per minute. The powder layer and the air layer in the powder fluidization unit 10 are balanced, the upper powder surface is made in a still state, and the fluidized state of the toner powder is formed.

The air pressure is impressed so that the internal pressure of the container is set to 15 kPa, the toner powder in the powder fluidization unit 10 is changed into the state where the powder filling nozzle is surrounded by the toner powder, and the toner powder is discharged through the powder filling nozzle 17 into the container 18.

Next, the subsequent operations in the following items (3) to (6) will be explained.

(3) The Stopping of the Toner Powder Discharge at the Time of Using the Powder Filling Nozzle (Indicated in the Following Items (4) and (5)) of the Present Invention Using the powder filling nozzle of this invention, the toner powder is discharged into the powder container as in the above item (2), and the weight of the container 18 is measured beforehand by the balance (the load cell 6 kgf). When the discharge toner powder reaches the predetermined weight, the gas suction unit is operated so that the suction pressure is set to −20 kPa. While the air is discharged, the outlet of the nozzle is closed and the discharge of toner is stopped instantly.

(4) The Powder Filling Nozzle of the Double Pipe Structure for Use in the Experiment (see FIG. 3)

The first tubular body 30 that constitutes this nozzle of the double pipe structure is made of a stainless steel pipe having a length of about 400 mm, a inner diameter of 6 mm, and an outer diameter of 7 mm. At the position of 5 mm apart from the end of the steel pipe, and at the position of 12 mm therefrom, and further at the positions in the intersecting direction (the total of eight places) there are formed the through holes 33 each having a diameter of 3 mm, respectively. A stainless steel mesh (made of a twill-weave filter material, 500/3500) is attached to the portion having a width of about 10 mm, so that the filter part 32 is formed in the surroundings of the through holes and the through holes are covered with the stainless steel mesh.

The second tubular body 31 is made of a stainless steel pipe having a length of about 450 mm, a inner diameter of 8 mm, and an outer diameter of 9 mm, the first gas exhausting port 34 is prepared near the end of the steel pipe, and both the ends of the steel pipe are soldered (Sn—Pb alloy) after the first tubular body 30 is inserted in the second tubular body 31. In this manner, the double pipe structure nozzle is formed.

The first gas exhausting port 34 is connected with the first gas suction unit (the product ME-60 from Koganei Co.) which is prepared separately.

(5) The Powder Filling Nozzle of the Triple Pipe Structure for Use in the Experiment (see FIG. 4)

The first tubular body 30 and the second tubular body 31 that constitute the nozzle of the triple pipe structure are the same as those of the double pipe structure nozzle of the item 5 above, the sealing and fixing of the ends of the nozzle is similarly carried out by soldering (Sn—Pb alloy).

The third tubular body 37 is made of a stainless steel pipe having a length of about 500 mm, a inner diameter of 11 mm, and an outer diameter of 12 mm. The through holes 38 each having a diameter of 5 mm are formed in the total of 11 places by the pitch of 8 mm from the position of 15 mm apart from the end of the stainless pipe, respectively. Moreover, the through holes 38 each having a diameter of 5 mm are formed in the total of ten places by the pitch of 8 mm in the intersecting direction from the position of 19 mm apart from the end of the stainless pipe, respectively is prepared.

A stainless steel mesh (made of a twill-weave filter material, 500/3500) is attached to the portion having a width of about 100 mm, so that the filter part 39 is formed in the surroundings of the through holes and the through holes are covered with the stainless steel mesh. The second gas exhausting port 40 is formed near the end of the pipe.

After the first tubular body 30 is inserted into and the second tubular body 31, the sealing and fixing of the ends of the third tubular body 37 is carried out by soldering (Sn—Pb alloy). In this manner, the triple pipe structure nozzle is formed.

The second gas exhausting port 40 is connected with the second gas suction unit (the product ME-60 from Koganei Co.) which is prepared separately.

(6) The Stopping of the Toner Powder Discharge at the Time of Using the Powder Filling Nozzle for Comparison The filling nozzle for comparison is made of a stainless steel pipe having a length of about 400 mm, a inner diameter of 6 mm, and an outer diameter of 7 mm.

Using this filling nozzle for comparison, a toner powder is discharged by the powder container as in the item 2 above, and the weight of the container 18 is measured beforehand by the balance (the load cell 6 kgf).

The impression of air pressure is stopped by the introductory gas control valve 20 provided in the powder fluidization unit 10, when the weight of the discharge toner powder reaches the predetermined weight. At the same time, the pressure supply of the powder fluidization unit 10 is turned ON by the pressure open valve 13, so that the pressure is balanced with the atmospheric pressure. However, the discharge of toner is not able to be stopped instantly.

(7) Comparative Evaluation of the Powder Delivery Stopping Function of the Powder Filling Nozzle When the powder filling nozzle of the double pipe structure is used, the series of the above operations related to the toner powder discharge to the container is carried out. Such is performed for the case of the embodiment 1 in which the powder filling nozzle of the double pipe structure is used, the case of the embodiment 2 in which the powder filling nozzle of the triple pipe structure is used, and the case of the comparative example 1 in which the powder filling nozzle for comparison is used. As for the toners of the four colors: cyan, magenta, yellow, and black, which constitute the Type 8000 toner for use in Ricoh color laser printers, the experiment is repeatedly carried out for 100 containers (the total of 400), the accuracy of the filling amount is checked based on the ratio of the lacking amount to the target filling amount of each toner powder in the container by using the standard deviation. In this manner, the powder delivery stopping function is evaluated.

The results are shown in FIG. 6 (3σ (sigma) denotes the filling accuracy; sigma: standard deviation (±3σ corresponds to the probability of 99.6%)).

When the target filling amount is set to 275 g and 550 g, the amount of lacking is 1.1-1.5 g and 2.2-2.3 g in the case of the embodiment 1 and the case of the embodiment 2, respectively, while it is 11.5-14.2 g and 24 g, in the case of the comparative example. It is apparent from FIG. 6 that the powder filling nozzle of the present invention has an excellent powder delivery stopping function in comparison with the comparative example.

(Check of the High-Density Filling Function of the Triple Pipe Structure Filling Nozzle of the Invention)

(1) High-Density Powder Filling of the Triple Pipe Structure Filling Nozzle

While discharging the toner powder into the container as in the above item (1) using the triple pipe structure filling nozzle, the second gas suction unit is operated so that the suction pressure is set to −30 kPa. Only the air is sucked and discharged from the nozzle which is surrounded by the toner powder, the nozzle is raised while the toner powder capacity is decreased, and the high-density state of the toner powder is formed within the container.

(2) Comparative Evaluation of the High-Density Powder Filling Function of the Powder Filling Nozzle The case in which the bulk density of the toner powder in the container is changed into a high-density state using the triple pipe structure filling nozzle of the above item (1) (case 1), and the case in which only the toner powder is discharged in the container using the triple pipe structure filling nozzle in the above item (1) (case 2) are compared. About the toners of four colors (cyan, magenta, yellow, black) which constitute the Type 8000 toner for Ricoh color laser printers, the experiment is carried out repeatedly on 100 containers (the total of 400), and the measurements of them are collected respectively, and the average value of the measured value for the 100 containers is computed.

The measurement of bulk density is performed using the mark which indicates the toner capacity in the container, and the mark which indicates the capacity level immediately after the filling is done. The bulk density is computed from the weight of the filling toner powder and the capacity. And the mark which indicates the capacity of the container is put using the water measured with the measuring cylinder.

The results are shown in FIG. 7. It is apparent from FIG. 7 that the triple pipe structure filling nozzle of the present invention provides a high-density filling function enough.

(3) Comparative Evaluation of the Filling Method by the Filling Time

The time required for discharging of the toner powder into the container using the powder filling nozzle of double pipe structure, and the powder filling nozzle for comparison as in the above item (1), making it sediment as it is, and filling up (the case of the embodiment 1 and the case of the comparative example), and after discharging the toner powder in the container using the powder filling nozzle of the triple pipe structure, the time required for attracting air and filling up (the case of the embodiment 2) are measured.

With respect to the black toner, the experiment is repeated performed for 100 containers (550 g/each), and the average filling time is measured.

As a result, the time in the case of the embodiment 1 is 35.1 seconds, while the time in the case of the comparative example is 41.8 seconds. The time in the case of the embodiment 2 is 18.5 seconds. Thus, it is confirmed that if the triple pipe structure filling nozzle of the invention is used, not only the powder delivery stopping function but also the high-density filling function is realized. Moreover, the triple pipe structure filling nozzle of the invention is effective in shortening of the filling time.

As described in the foregoing, according to the present invention, the powder filling nozzle, powder filling device, and powder filling method which make it possible to fill up the container with the powder of a given amount in a high-density state efficiently and precisely. That is, the flow state of the powder which introduced gas uniformly into the powder and is controlled by the minimum quantity of gas is acquired, a flow powder is flowed into the back or the bottom of a small-inlet filling container or a complicated-shaped filling container, and high density and the method of filling up with a non-particulate can be offered easily.

The invention claimed is:

1. A powder filling nozzle used for filling up a container with a powder mixed with a gas and in a fluidized state, comprising:

a tubular body having an opening for discharging the powder in the fluidized state into the container; and a gas separating unit disposed near the opening of the tubular body and allowing the gas delivered together with the powder in the tubular body to pass through the gas separating unit but not allowing the powder to pass through the gas separating unit, wherein the gas separating unit serves to set the opening in a plugged state by the powder separated from the gas, so that the delivery of the powder from the tubular body into the container is stopped, wherein the tubular body has a double pipe structure including a first tubular body and a second tubular body, the first tubular body being inserted into the second tubular body so that a gap between the two tubular bodies is formed as a gas delivery path, both ends of the second tubular body being fixed to the first tubular body so as to close the gap, the first tubular body serving as a delivery path which discharges the powder in the fluidized state fed from one opening of the first tubular body into the container through the other opening of the first tubular body, the gas separating unit including a first filter part which does not pass the powder therethrough but allows the gas to pass therethrough, the second tubular body having a gas exhausting port connected with an external gas suction unit, and the second tubular body having a function of discharging the gas, passing through the first filter part and being attracted to the first tubular body by operation of the external gas suction unit, from the gas exhausting port through the gas delivery path, and wherein the tubular body has a triple pipe structure including a third tubular body in addition to the first and second tubular bodies, the third tubular body having an inner diameter larger than an outer diameter of the second tubular body, the second tubular body being inserted into the third tubular body so that a gap between the second and third tubular bodies is formed as a second gas delivery path, both ends of the third tubular body being fixed to the second tubular body so as to close the gap between the second and third tubular bodies at both ends thereof, the third tubular body including a second filter part at an outer circumference thereof, the third tubular body having a second gas exhausting port connected with a second external gas suction unit, and the third tubular body having a function of attracting through the second filter part the gas, existing in the powder discharged into the container, by operation of the second gas suction unit, and having a function of discharging the gas, passing through the second delivery path between the second tubular body and the third tubular body, from the second gas exhausting port.

2. The powder filling nozzle of claim 1 wherein the opening of the tubular body is constituted by a through hole which is formed in the first tubular body, and the gas separating unit includes the first filter part which is provided on a circumference of the first tubular body so that the through hole is covered with the filter part.

3. The powder filling nozzle of claim 1 wherein the first tubular body has a lamination structure in which a tubular member of a filter material and a tubular member of a non-filter material are bonded, and the tubular member of the filter material serves as the first filter part.

4. The powder filling nozzle of claim 2 wherein the first filter part is made of a twill-weave filter material.

5. The powder filling nozzle of claim 3 wherein the first filter part includes a laminated member made of two or more filter materials with different meshes.

6. The powder filling nozzle of claim 5 wherein the laminated member has a fine-mesh filter material at an inner core portion of the first tubular body.

7. The powder filling nozzle of claim 1 wherein a width of the first filter part is larger than 0.3 times an inner diameter of the opening of the first tubular body.

8. A powder filling device including a hermitically sealed powder fluidization unit and a powder filling nozzle, the powder filling device filling a powder, mixed with a gas and changed to a fluidized state by the powder fluidization unit, into a container through a delivery path by using the powder filling nozzle, the powder filling nozzle comprising:

a tubular body having an opening for discharging the powder in the fluidized state into the container; and a gas separating unit disposed near the opening of the tubular body and allowing the gas delivered together with the powder in the tubular body to pass through the gas separating unit but not allowing the powder to pass through the gas separating unit, wherein the gas separating unit serves to set the opening in a plugged state by the powder separated from the gas, so that the delivery of the powder from the tubular body into the container is stopped, wherein the tubular body has a double pipe structure including a first tubular body and a second tubular body, the first tubular body being inserted into the second tubular body so that a gap between the two tubular bodies is formed as a gas delivery path, both ends of the second tubular body being fixed to the first tubular body so as to close the gap, the first tubular body serving as a delivery path which discharges the powder in the fluidized state fed from one opening of the first tubular body into the container through the other opening of the first tubular body, the gas separating unit including a first filter part which does not pass the powder therethrough but allows the gas to pass therethrough, the second tubular body having a gas exhausting port connected with an external gas suction unit, and the second tubular body having a function of discharging the gas, passing through the first filter part and being attracted to the first tubular body by operation of the external gas suction unit, from the gas exhausting port through the gas delivery path, and wherein the tubular body has a triple pipe structure including a third tubular body in addition to the first and second tubular bodies, the third tubular body having an inner diameter larger than an outer diameter of the second tubular body, the second tubular body being inserted into the third tubular body so that a gap between the second and third tubular bodies is formed as a second gas delivery path, both ends of the third tubular body being fixed to the second tubular body so as to close the gap between the second and third tubular bodies at both ends thereof, the third tubular body including a second filter part at an outer circumference thereof, the third tubular body having a second gas exhausting port connected with a second external gas suction unit, and the third tubular body having a function of attracting through the second filter part the gas, existing in the powder discharged into the container, by operation of the second gas suction unit, and having a function of discharging the gas, passing through the second delivery path between the second tubular body and the third tubular body, from the second gas exhausting port.

9. The powder filling device of claim 8 wherein the powder filling device works with an electric power obtained from at least one of natural power sources including a sunlight energy and a wind power energy and used as a source of power.

10. The powder filling device of claim 8 wherein a lid member which is made of a ventilation porous material and includes a hole for inserting the powder filling nozzle therein is fitted into an opening of the container in a state in which the powder filling nozzle is inserted in the hole of the lid member.

11. The powder filling device of claim 8 wherein the powder fluidization unit has an introductory gas control valve which is capable of adjusting a flow velocity of introductory gas, and a delivery powder flow velocity control valve which is capable of adjusting a flow velocity of the powder in the fluidized state within the delivery path.

12. The powder filling device of claim 8 wherein the powder fluidization unit has a gas introducing unit for changing the powder into the fluidized state, and the gas introducing unit is a pressure vessel in which the gas is contained in a manner that the gas can be fed to the powder fluidization unit.

13. The powder filling device of claim 8 wherein the powder fluidization unit has a gas introducing unit for changing the powder into the fluidized state, and the gas introducing unit is a gas delivery pump with a check valve.

14. The powder filling device of claim 8 wherein the powder fluidization unit has a gas introducing unit for changing the powder into the fluidized state, and a gas dispensing unit for introducing the gas into the powder fluidization unit uniformly.

15. The powder filling device of claim 8 wherein the powder is a toner for developing an electrostatic latent image.

16. A powder filling method for filling up a container with a powder in a fluidized state by using a powder filling device which includes a hennitically sealed powder fluidization unit and a powder filling nozzle, the powder filling nozzle comprising a tubular body having an opening for discharging the powder in the fluidized state into the container, and a gas separating unit disposed near the opening of the tubular body and allowing a gas delivered together with the powder in the tubular body to pass through the gas separating unit but not allowing the powder to pass through the gas separating unit, wherein the tubular body has a double pipe structure including a first tubular body and a second tubular body, the first tubular body being inserted into the second tubular body so that a gap between the two tubular bodies is formed as a gas delivery path, both ends of the second tubular body being fixed to the first tubular body so as to close the gap, the first tubular body serving as a delivery path which discharges the powder in the fluidized state fed from one opening of the first tubular body into the container through the other opening of the first tubular body, the gas separating unit including a first filter part which does not pass the powder therethrough but allows the gas to pass therethrough, the second tubular body having a gas exhausting port connected with an external gas suction unit, and the second tubular body having a function of discharging the gas, passing through the first filter part and being attracted to the first tubular body by operation of the external gas suction unit, from the gas exhausting port through the gas delivery path, and wherein the tubular body has a triple pipe structure including a third tubular body in addition to the first and second tubular bodies, the third tubular body having an inner diameter larger than an outer diameter of the second tubular body, the second tubular body being inserted into the third tubular body so that a gap between the second and third tubular bodies is formed as a second gas delivery path, both ends of the third tubular body being fixed to the second tubular body so as to close the gap between the second and third tubular bodies at both ends thereof, the third tubular body including a second filter part at an outer circumference thereof, the third tubular body having a second gas exhausting port connected with a second external gas suction unit, and the third tubular body having a function of attracting through the second filter part the gas, existing in the powder discharged into the container, by operation of the second gas suction unit, and having a function of discharging the gas, passing through the second delivery path between the second tubular body and the third tubular body, from the second gas exhausting port the powder filling method comprising the steps of:

mixing the powder contained in the powder fluidization unit with the gas to obtain the powder in the fluidized state;

delivering the powder in the fluidized state from the fluid fluidization unit into the powder filling nozzle via a delivery path so that the powder is discharged into the container from the powder filling nozzle; and setting the opening of the tubular body in a plugged state by the powder separated from the gas by the gas separating unit so that the delivery of the powder from the tubular body to the container is stopped.

17. The powder filling method of claim 16 wherein a bulk density of the powder at a time of delivery is in a range of 0.1 to 0.2.

18. The powder filling method of claim 16 wherein a lid member in which the nozzle is inserted and held is fitted in the container, and the powder is discharged through the nozzle into the container.

19. The powder filling method of claim 16 wherein the fluidization of the powder into the fluidized state is performed by introducing additional gas into the powder fluidization unit.

20. The powder filling method of claim 16 wherein the fluidization of the powder with the gas is performed by vibrating the powder fluidization unit.

21. The powder filling method of claim 16 wherein the delivery of the powder from the powder fluidization unit to the nozzle is performed by increasing a pressure within the powder fluidization unit.

22. The powder filling method of claim 16 wherein the delivery of the powder from the powder fluidization unit to the nozzle is performed by applying an external pressure to the powder fluidization unit and decreasing an internal volume of the powder fluidization unit.

23. The powder filling method of claim 16 wherein the delivery of the powder in the fluidized state by the powder fluidization unit is stopped by operation of a first gas suction unit.

24. The powder filling method of claim 16 wherein a bulk density of the powder at a time of stopping is in a range of 0.4 to 0.5.

25. The powder filling method of claim 16 wherein an amount of discharge of the powder in the fluidized state is controlled by regulation of a suction pressure by operation of the first gas suction unit.

26. The powder filling method of claim 23 wherein a gas suction pressure of the first gas suction unit is in a range of −10 kPa to −60 kPa.

27. The powder filling method of claim 16 wherein an amount of discharge of the powder in the fluidized state is controlled by regulation of opening and closing of an introductory gas control valve or a discharge powder flow velocity control valve of the powder fluidization unit.

28. The powder filling method of claim 16 wherein a gas suction pressure of the second gas suction unit is in a range of −10 kPa to −60 kPa.

29. The powder filling method of claim 18 wherein, when the container is filled up with a given amount of the powder, the delivery of the powder is stopped and the lid member is removed from the container.

30. The powder filling method of claim 16 wherein the powder is a toner for developing an electrostatic latent image.

31. A container with which the powder is filled according to the powder filling method of claim 16.

* * * * *